US006367187B2

(12) United States Patent
Bubits

(10) Patent No.: US 6,367,187 B2
(45) Date of Patent: Apr. 9, 2002

(54) HOLSTER STOCK FOR PISTOLS

(76) Inventor: Wilhelm Bubits, Franz-Anderle-Platz 4/4/6, A-2345 Brunn/Gebirge (AT)

( * ) Notice: Subject to any disclaimer, the term of this patent is extended or adjusted under 35 U.S.C. 154(b) by 0 days.

(21) Appl. No.: 09/795,806

(22) Filed: Feb. 28, 2001

(30) Foreign Application Priority Data

Jul. 19, 2000 (AT) ..... 529/00 U

(51) Int. Cl.[7] ..... F41C 23/00
(52) U.S. Cl. ..... 42/72; 42/71.02
(58) Field of Search ..... 42/72, 71.02, 73, 42/74, 71.01

(56) References Cited

U.S. PATENT DOCUMENTS 3,861,273 A * 1/1975 Seidel et al. ..... 42/72
4,271,623 A * 6/1981 Beretta ..... 42/72
5,761,842 A * 6/1998 Mantymaa ..... 42/72
5,778,588 A * 7/1998 Allen, III et al. ..... 42/72

* cited by examiner

*Primary Examiner*—J. Woodrow Eldred
(74) *Attorney, Agent, or Firm*—Bachman & LaPointe, P.C.

(57) ABSTRACT

A holster stock for pistols comprises a shoulder piece (11) and a holding part (12). The pistol has a housing (2) with a grip (3) which projects downward and is at least partially hollow, and has a slide (5) which is guided on the upper part (4) of the housing. The holding part (12) of the holster stock is attached to the grip (3) of the pistol. To combine a firm connection to the pistol with a good grip feel, the holding part (12) has a lower strut (14) and an upper strut (13). The struts run approximately in the firing direction. The lower strut (14) ends in a guide strip (20) which points upward and is inserted from underneath the grip (3) into guides (35) in the interior of the grip (3) while the upper strut (13) bears against the upper part (4) of the housing (1).

7 Claims, 3 Drawing Sheets

HOLSTER STOCK FOR PISTOLS

BACKGROUND OF THE INVENTION

The invention relates to a holster stock for pistols, the holster stock comprises a shoulder piece and a holding part, the pistol comprises a housing with a grip which projects downward and is at least partially hollow, and a slide which is guided on the upper part of the housing, wherein the holding part of the holster stock can be attached to the grip of the pistol.

When a pistol is intended to be used for relatively long ranges or for rapidly successive shots, or when increased hit accuracy is required, the weapon needs to be supported on the shoulder of the person firing it. Folding shoulder supports are known for automatic pistols; their purpose there is to be folded in for easier transportation. However, they are always unfolded for use. Generally, they are not removable.

From practical use of pistols, it is known for the holster stock to be attached to the grip from the outside, so that either guide rails are provided on the outside of the grip, or the grip is even surrounded by a holder when being used with the holster stock, in order to achieve a firm connection. However, the intention is that the holster stock should always be connected to the pistol without any play, and should absorb the recoil force, during aiming and firing. This is not achieved by the prior art in either case. Furthermore, the grip is interfered with by the stock fitted on the outside of the handle, which adversely affects the handling and hit accuracy. The person firing the weapon wants to be able to hold the grip both securely and conveniently with or without the holster stock.

It is the principle object of the invention to provide a holster stock which can be firmly connected to the pistol in a manner such that the grip is not adversely affected either with or without the holster stock attached.

SUMMARY OF THE INVENTION

The foregoing object is achieved according to the invention in that the holding part of the holster stock has a lower strut and an upper strut, which struts run approximately in the firing direction, the lower strut ends in a guide strip which points upward and can be inserted from underneath into guides in the interior of the grip of the pistol, and with the upper strut bearing against the upper part of the housing of the pistol.

When the guide strip is accommodated in the interior of the grip, the exterior of the grip is entirely unchanged and it feels just the same to the person firing the weapon. Since the grip is already hollow in order to reduce the weight and to accommodate the magazine, it involves only minor design effort to accommodate the guide strip. Since the entire depth of the grip is available, a highly stiff connection is also achieved. The foregoing is further improved by the upper strut bearing against the upper part of the housing. The upper strut can also absorb the recoil force directly without impeding the return travel of the slide. No connecting means are required, since the recoil force is actually a compression force. Furthermore, the two struts, which point longitudinally and are arranged at a vertical distance from one another, define sufficient space for the person firing the weapon to pass a hand through.

Guides in the grip preferably have grooves which are formed in the rear part of the side walls of the grip, and the side edges of the guide strip can be inserted into these grooves. The grooves in the side walls offer an adequate guide width, so that the guide can also absorb bending moments, and even lateral forces with sufficient accuracy. In this case, the guides may themselves be profiled differently. Since the edges of the groove have to project inward since the grip wall is not very thick, they also reinforce the grip.

The arrangement of the guides in the rear part improves the space utilization, since the rear, rounded part of the interior cannot be used for the magazine. The guides can thus at the same time be used for bounding the space which is formed in the interior of the grip for the magazine, that is to say even as a magazine guide.

In one preferred embodiment, the lower strut and the upper strut of the holding part are part of a closed reinforced zone which extends from the guide strip to the end, adjacent to the housing, of the upper strut. The ends of the struts, which absorb both forces, are thus connected to one another by the shortest path around the grip opening, resulting in closed lines of force. If the holster stock is made of plastic, the closed reinforced zone is a metal part embedded in the plastic.

In a further development of the invention, a locking element is provided which counteracts movement in the direction of the guides. This may be designed in widely differing ways. One particularly practical and nice solution is for the locking element to be a spring-loaded spherical part, which engages from the inside in a depression in the rear wall of the grip. The grip sense and the view are thus not adversely affected.

BRIEF DESCRIPTION OF THE DRAWINGS

The invention will be described and explained in the following text with reference to figures, wherein.

DETAILED DESCRIPTION

Figure 1:
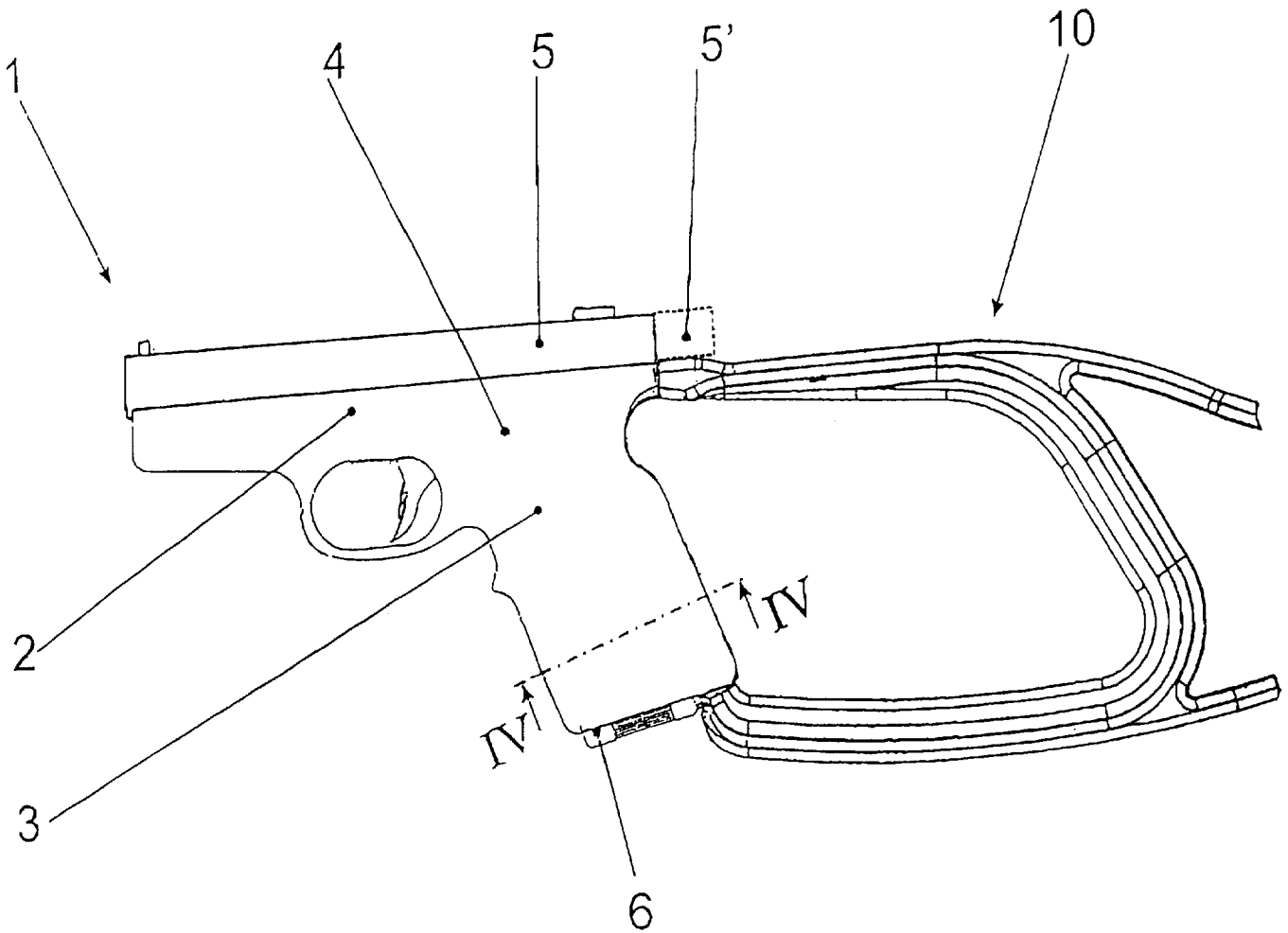
FIG. 1 shows the holster stock according to the invention with a pistol.

In FIG. 1, a pistol is denoted overall by 1 and the holster stock (shown cut away) is denoted by 10. The housing 2 of the pistol is of the normal design and has a hollow grip 3 and an upper guide part 4, which is the upper part of the housing, on which a slide 5 is guided, which slide 5 contains a barrel (which cannot be seen) and a breech. A magazine 6 can be inserted into the grip 3 from underneath. The rearward position of the slide 5 is indicated by dashed lines and is denoted by 5'.

Figure 2:
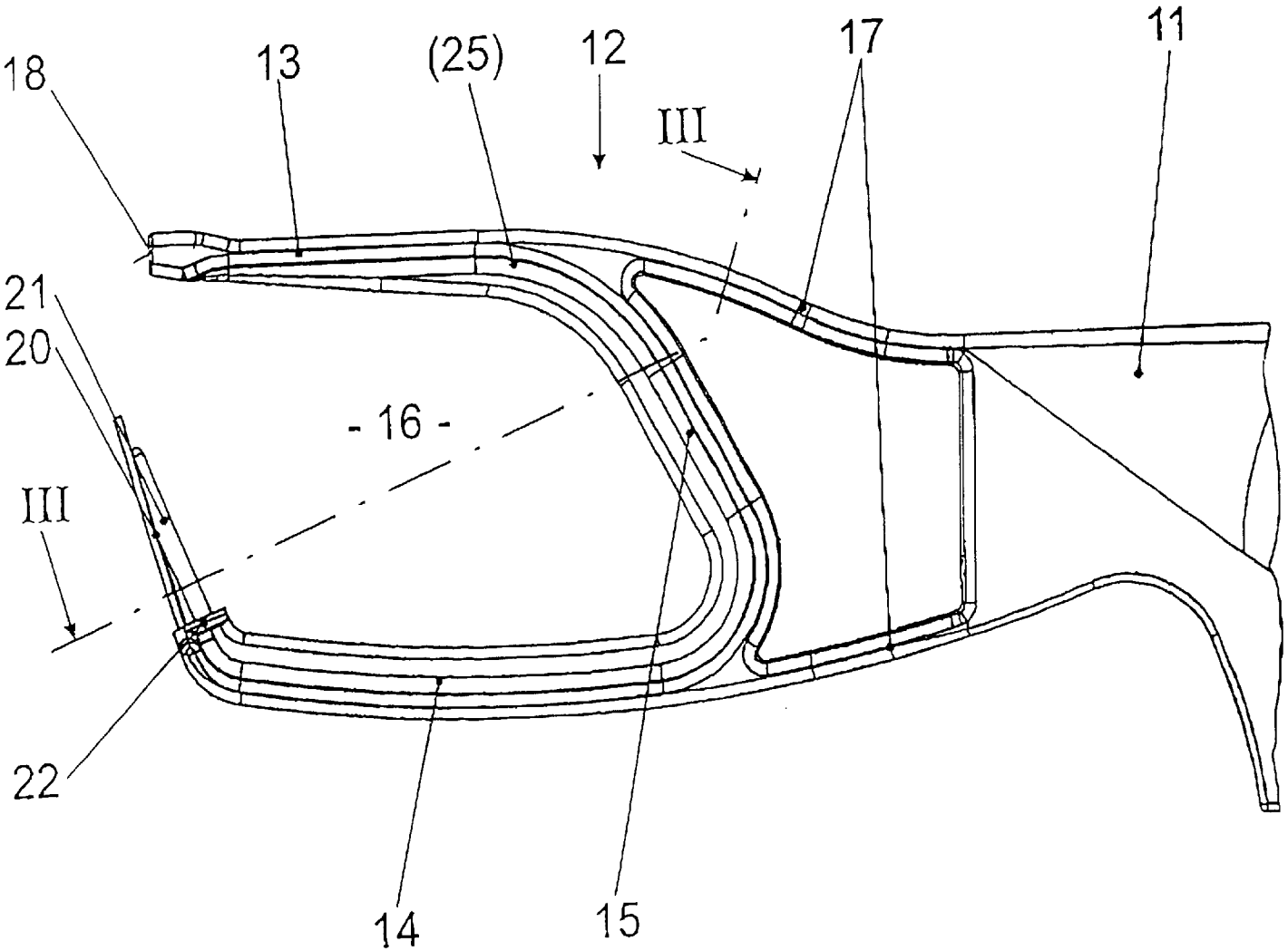
FIG. 2 shows the holster stock according to the invention without a pistol.

FIG. 2 shows somewhat more of the holster stock 10; the shoulder piece 11 is again cut away. Adjacent to the shoulder piece 11 at the front thereof is a holding part 12, which comprises an upper strut 13, a lower strut 14 and an intermediate strut 15. These three struts 13, 14, 15 form an approximately C-shaped closed zone and define a grip opening 16 for the hand and ball of the thumb of the person firing the weapon. There are connecting struts 17, which produce the connection between the struts 13, 14, 15 and the shoulder piece 11, in an adjacent position approximately as an extension to the upper and lower struts 13, 14. These may be elastic. The upper strut 13 ends in a stock surface 18. The lower strut 14 is bent at its front end and forms a guide strip 20 with a reinforcing rib 21 to increase the bending stiffness, and which merges into the lower strut 14 on a stock plate 22.

Figure 3:
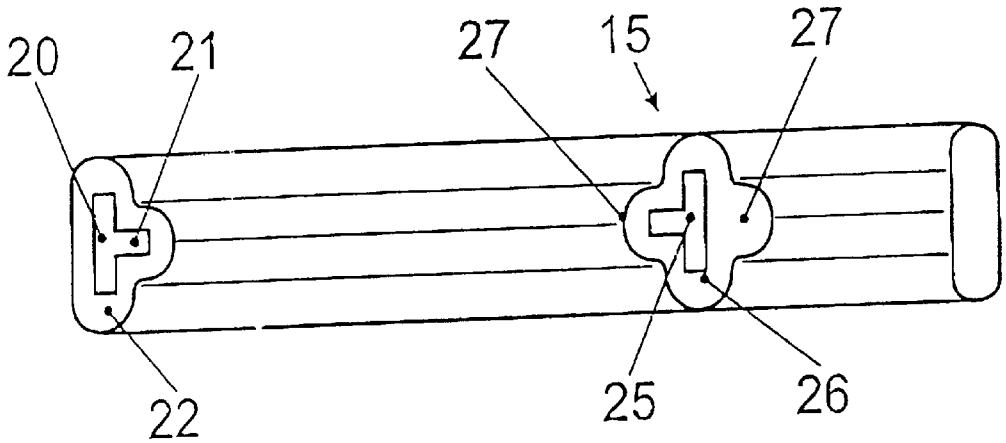
FIG. 3 shows a section along III—III in FIG. 2.

The cross section of the guide strip 20 with the reinforcing rib 21 can be seen better in FIG. 3. The cross section of the intermediate strut 15 in the illustrated exemplary embodiment comprises a reinforced zone 25 and a plastic sheath 26 surrounding it. The reinforced zone 25 may be a metal bracket passing through the struts 13, 14 and 15 and extrusion-coated with plastic. Provided the plastic is sufficiently hard, the metallic reinforcement may also be omitted. The cross section is then simply that of the plastic sheet, with the ribs 27 ensuring the bending stiffness of the closed zone, which is C-shaped overall.

Figure 4:
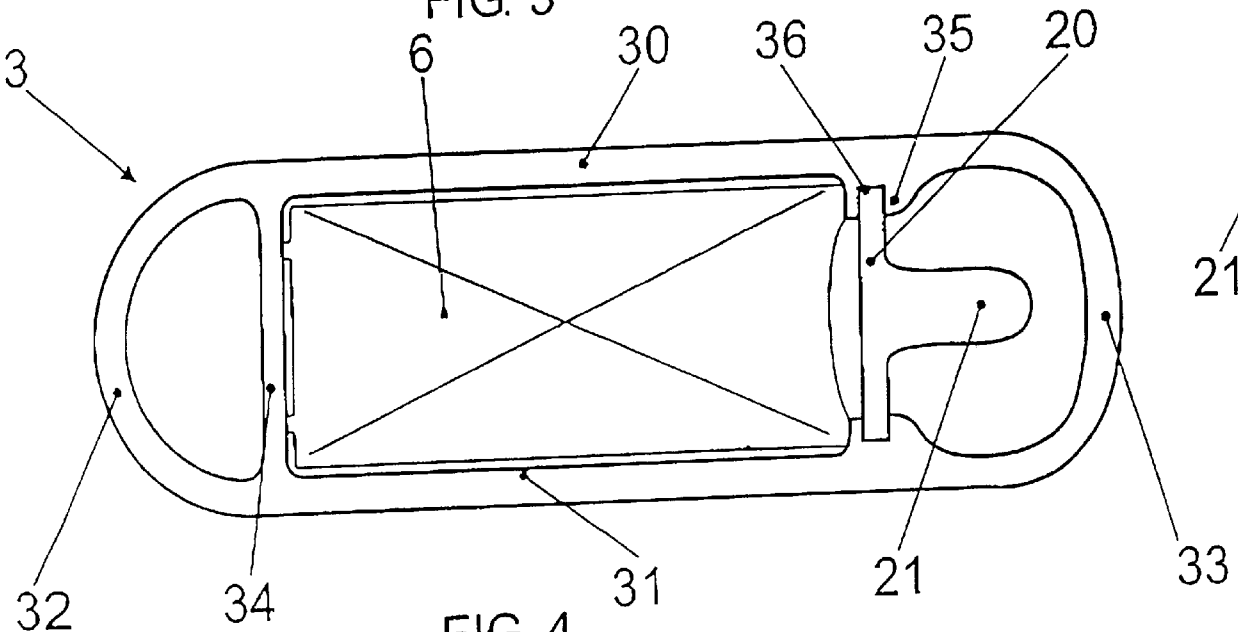
FIG. 4 shows a section along IV—IV in FIG. 1.

FIG. 4 shows a section through the hollow grip 3. This comprises side walls 30, 31 which are connected at the front and rear by respective suitably shaped round walls 32, 33 to form a closed profile and which are reinforced by a transverse wall 34 approximately at the junction between the side walls 30, 31 and the front round wall 32. Reinforcements 35 with cross sections in the form of tabs are provided in the two side walls 30, 31, approximately at the junction to the rear round wall 33. Firstly, in conjunction with the transverse wall 34, these reinforcements 35 form the guide for the magazine 6. Secondly, they form the guide for the guide strip 20. For this purpose, they have guide grooves 36, into which the side edges of the guide strip 20 are inserted. The guide strip 20 is inserted into the grip 3 to a sufficient depth that its lower closure rests on the stop plate 22.

FIG. 1 shows the pistol with the holster stock 10 in the fitted position achieved in this way. In this position, the stock surface 18 (see FIG. 2) of the upper strut 13 bears against the rear wall of the upper part of the housing 2 of the pistol. There is no need for any connection or attachment at this point, since the stiffness of the lower strut 14 and of the guide strip 20 together with the reinforcing rib 21 ensure that the pistol is guided cleanly and without play, both in the firing direction and in the transverse direction. The recoil produced on firing acts as a compression force directly from the upper part of the housing onto the upper strut 13.

Figure 5:
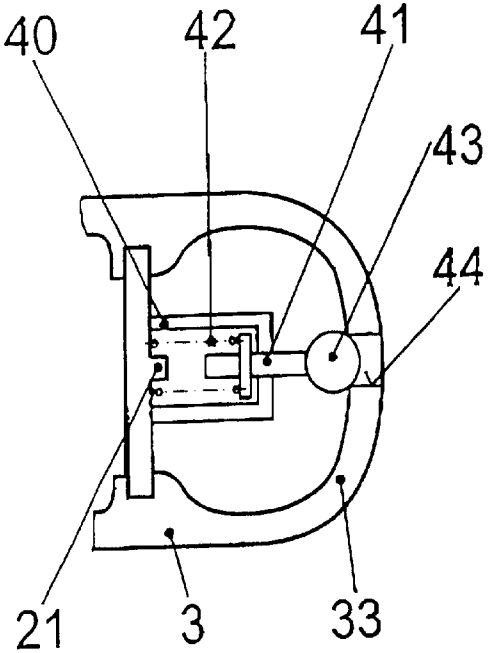
FIG. 5 shows a variant as in FIG. 4.

FIG. 5 shows one possible way of locking the guide strip, once it has been inserted into the grip 3, such that it cannot be pulled out without taking some further action. In the exemplary embodiment shown in FIG. 5, the reinforcing rib 21 is broadened to form a spring housing 40 at the point of the illustrated section. This spring housing 40 contains a pin 41 which is pressed outward by a spring 42 and has a spherical head 43 which engages in a detent or hole 44 in the rear round wall of the grip 3. In order to pull the guide strip 20 out of the grip, it is either necessary to push it out of the hole 44 against the spring force of the spherical head 43, or to push it out from the outside using a pen. A range of other solutions are feasible for locking within the scope of the invention.

The foregoing design results in a light, stiff and handy holster stock, which can easily be attached to the pistol and which, furthermore, requires no changes whatsoever to the pistol, except for possibly only minor changes to the interior of the hollow grip.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. In combination, a pistol having a holster stock comprising a shoulder piece and a holding part, the pistol comprises a housing with a grip which projects downwardly and is at least partially hollow, and a slide which is guided on an upper part of the housing, wherein the holding part of the holster stock is attached to the grip of the pistol, wherein the holding part has a lower strut and an upper strut which struts run approximately in the firing direction, the lower strut ends in a guide strip which points upward and is inserted from underneath the grip into guides formed in the at least partially hollow interior of the grip, such that the upper strut bears against the upper part of the housing.

2. The combination as claimed in claim 1, wherein the guides define in part a space for the guide strip and have grooves formed in a rear part of side walls of the grip, and side edges of the guide strip are inserted into the grooves.

3. The combination as claimed in claim 2, wherein the guides further define a space which is formed in the interior of the grip for the magazine.

4. The combination as claimed in claim 1, wherein the lower strut and the upper strut of the holding part are part of a closed reinforced zone, adjacent to the housing, which extends from the guide strip to the stock surface of the upper strut.

5. The combination as claimed in claim 3, wherein the closed reinforced zone contains a metal part embedded in a plastic sheath.

6. The combination as claimed in claim 1, wherein a locking element is provided for locking the guide strip in the interior of the grip.

7. The combination as claimed in claim 6, wherein the locking element comprises a spring-loaded spherical part on the guide strip which engages a detent formed in the grip.

* * * * *